United States Patent [19]

Wilkins et al.

[11] 4,119,039

[45] Oct. 10, 1978

[54] FUZE SYSTEM

[75] Inventors: Paul E. Wilkins, Fairfax, Va.; Glenn E. Neville, Washington, D.C.; Robert T. Fitzgerald, Rockville, Md.

[73] Assignee: The United States of America as represented by the Secretary of the Army, Washington, D.C.

[21] Appl. No.: 113,991

[22] Filed: May 29, 1961

[51] Int. Cl.[2] ..... F42C 13/04

[52] U.S. Cl. ..... 102/214; 343/112 CA

[58] Field of Search ..... 102/70.2; 343/112, 4, 343/7; 328/5, 96, 151

[56] References Cited

U.S. PATENT DOCUMENTS

| | | | |
|---|---|---|---|
| 2,509,910 | 5/1950 | Dike | 102/70.2 |
| 2,931,300 | 4/1960 | Lord et al. | 102/70.2 |

*Primary Examiner*—Charles T. Jordan

*Attorney, Agent, or Firm*—Nathan Edelberg; Robert P. Gibson; Saul Elbaum

EXEMPLARY CLAIM

1. A fuze system comprising in combination: an antenna, a plurality of independent channels, a firing circuit, and detonator means; each of said channels comprising oscillating detector means for generating a transmitting signal and a monitoring signal, said detector means upon receipt of a target signal having an output container a doppler frequency component, amplifying means connected to said oscillating detector means, means connected to said amplifying means for separating said monitoring signal from said doppler target signal, and rectifying means for forming a d-c holding bias from said monitoring signal; said firing circuit having first and second inputs; means for applying both the holding bias and the doppler target signal of one of said channels to said first firing circuit input, and means for applying both the holding bias and the doppler target signal of another one of said channels to said second firing circuit input said means responsive to said monitoring means enabling said fuze to operate by any remaining channels upon failure of one channel; said detonator means being connected to the output of said firing circuit.

4 Claims, 6 Drawing Figures

INVENTOR
PAUL E. WILKINS
GLENN E. NEVILLE
ROBERT. T. FITZGERALD
BY S. J. Rotondi, A. T. Dupont, T. E. McGee & J. P. Vandenburg

INVENTOR

PAUL E. WILKINS
GLENN E. NEVILLE
ROBERT T. FITZGERALD

BY S. J. Rotondi, A. T. Dupont, T. E. McGee & J. P. Vandenburg

INVENTOR
PAUL E. WILKINS
GLENN E. NEVILLE
ROBERT T. FITZGERALD
BY S. J. Rotondi, A. I. Dupont, F. E. McGee & J. P. Vandenburg

INVENTOR

PAUL E. WILKINS
GLENN E. NEVILLE
ROBERT T. FITZGERALD

BY S. J. Rotondi, A. J. Dupont, F. E. McGee & J. P. Vandenburg

INVENTORS
PAUL E. WILKINS
GLENN E. NEVILLE
ROBERT T. FITZGERALD
BY S. J. Rotondi, A. T. Dupont, F. E. McBee & J. P. Vandenburg

FUZE SYSTEM

The invention described herein may be manufactured and used by or for the Government for governmental purposes without the payment to use of any royalty thereon.

This invention relates to ordnance fuzes for military projectiles, such as guided missiles, and more particularly to electronic proximity fuzes containing a plurality of independent channels.

One of the most critical requirements that proximity fuzes must fulfill is a high degree of reliability in functioning its explosive in the presence of a target. The reliability of VHF radio proximity fuzes may be increased by providing more than one channel in the fuze, if the channels are independent and have similar target response characteristics. The several channels are coupled to a thyratron firing circuit which may have one or more detonators serving as its output load. Each channel normally includes a transmitter, a power supply, and a receiver with a detector and amplifying means connected between the detector and the channel output terminals.

Three possible kinds of fuze response are encountered in actual operation. Each channel is designed to generate a target-indicating signal for application to the firing circuit when the projectile reaches a predetermined distance from a target, termed the design burst height. However, the projectile can be expected to inflict substantial damage to a target at any position from zero range up to a specified maximum range, typically 2 or 3 times the design burst height. The first kind of fuze response, then, is a proper function in which the firing circuit is actuated and energizes the detonator at a distance less than or equal to the specified maximum range, but before impact. The second kind is an early function wherein an air burst occurs when the range is greater than this specified maximum range. The third possibility is a dud which is defined as a failure to energize the detonator before impact with the target. The reliability of the system may be expressed in terms of the probability distribution of these three functions. Through the use of plural channels interconnected in selected ways at the firing circuit inputs, the overall reliability of the entire fuze can be made greater than that of any individual channel, as will appear subsequently.

Prior attempts to improve fuze reliability by means of plural channels raised several problems which heretofore have made such an approach impracticable. For individual fuze channels having an early function probability of no more than 0.03 with a dud probability of no more than 0.02, present two channel systems fail to achieve any marked increase in the overall probability of a proper function. One such system involves the well known parallel firing circuit in which each channel is coupled to a single-grid thyratron and the two thyratrons have their plates coupled through separate charging condensers to a single detonator. The parallel firing circuit energizes the detonator whenever a predetermined positive voltage appears at the output of the first channel or the second channel or at both outputs simultaneously. The parallel system affords protection against duds, since the entire fuze produces a dud only when both channels fail. However, an early function in either channel produces a early function by the fuze. The result is that the parallel system offers good protection against duds but none against early functions and the probability of proper functions is no greater than for a single channel fuze of comparable design.

Another two channel system known in the art is the series type fuze. Its firing circuit comprises a single dual-grid thyratron with one control grid connected to the first channel output and its other control grid separately connected to the other channel of the fuze. In the series fuze, both channels must generate the required positive voltages coincident in time in order to fire the thyratron and energize the detonator. Protection against early functions is obtained by effectively converting potential dud rounds into early functions. An early function occurs only when both channels simultaneously function early. On the other hand, a dud in either channel prevents actuation of the firing circuit regardless of the other channel's response and the fuze then produces a dud. Again, the probability of proper function remains substantially the same as that for a similar single channel fuze.

It has been found that the probability of occurrence of a proper function can be markedly increased with a fuze incorporating three independent channels. In the latter case, the three channels are connected to a firing circuit, comprising three dual-grid thyratrons, in such a manner that generation of a target-indicating signal by any two channels at the correct time gives a proper function. However, the three channel fuze involves several inherent difficulties. In the first place, the extra channel adds to the weight of the fuze and the space it requires, both of which should be reduced as much as possible in the missile environment. Further, there is the severe problem of achieving the necessary independence among the three channels while retaining similar target responses. With proper shielding and component layout, the three amplifiers may be located in close proximity without objectionable crosstalk. Adequate separation of three sensitive transmitter oscillators is not so simply achieved. When the three oscillators are connected to the common antenna, they are reasonably well coupled by reason of such connection. Then, independence is largely the result of the individual channel selectivity. This in turn involves a compromise, since opimumly loaded oscillators have a relatively low Q and correspondingly low selectivity. Prior dual-channel fuzes required a wide separation of channel operating frequencies, for example 75 to 150 megacycles in order to assure the necessary isolation. It is apparent that equivalent isolation in a three-channel fuze would necessitate separation of the two outside oscillator frequencies by at least 500 megacycles. Since the electrical characteristics of the common antenna at such widely separated frequencies differ markedly, the various channel target responses cannot be made identical.

An object of the present invention is to improve the reliability of operation of ordnance fuzes.

Another object is to increase the probability of occurrence of proper functions in ordnance fuzes.

A further object of this invention is to reduce the number of independent channels required for high reliability in ordnance fuzes.

Still another object is to provide self-monitoring operation in each channel of a multichannel fuze.

An additional object is to monitor continuously each channel of a dual-channel fuze and upon detecting a failure in one channel to switch automatically to the remaining channel.

The specific nature of the invention, as well as other objects, uses and advantages thereof, will clearly appear from the following description and from the accompanying drawing, in which.

Figure 3A:
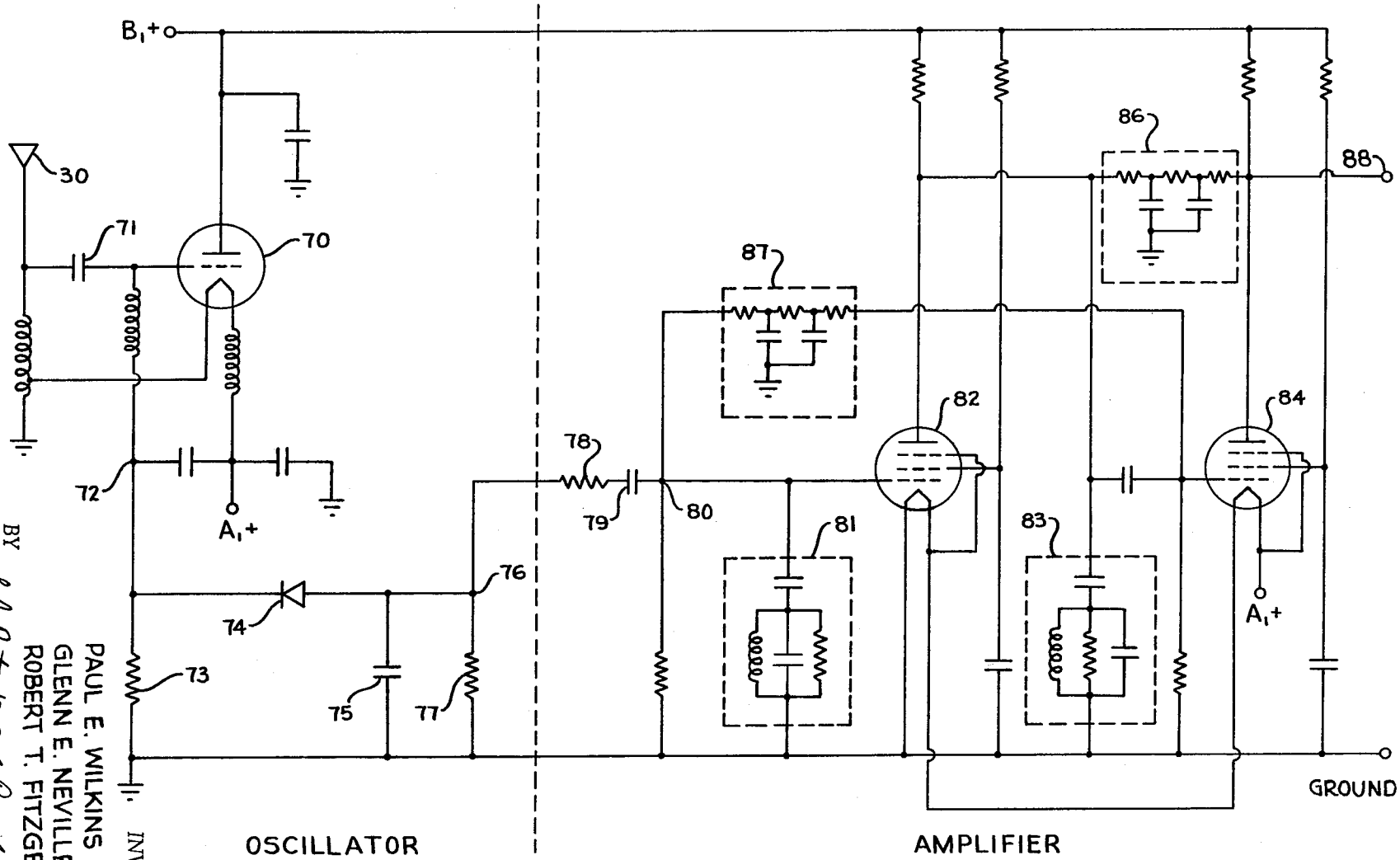
FIG. 3*a* is a schematic wiring diagram of one of the channels of the fuze of FIG. 2.
Figure 3B:
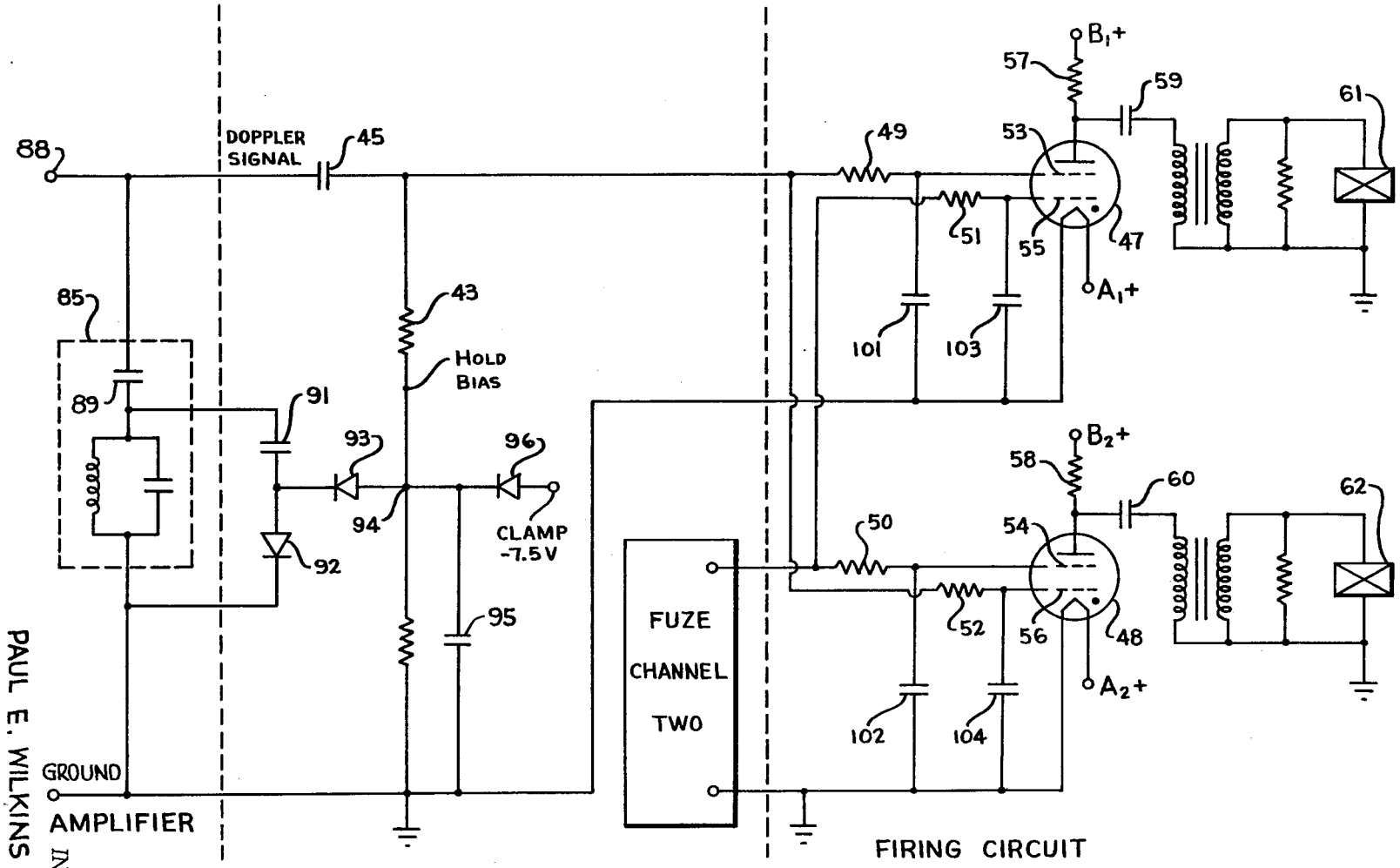
FIG. 3*b* is a continuation of the schematic wiring diagram of FIG. 3*a*.
Figure 4A:
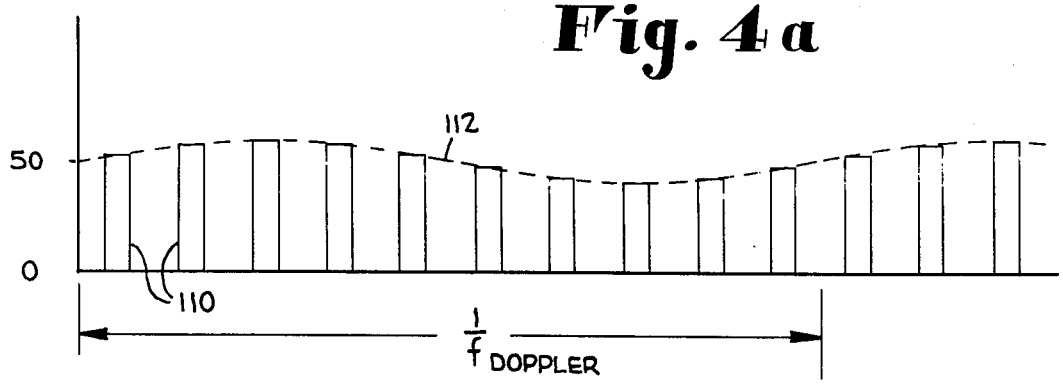
Figure 4B:
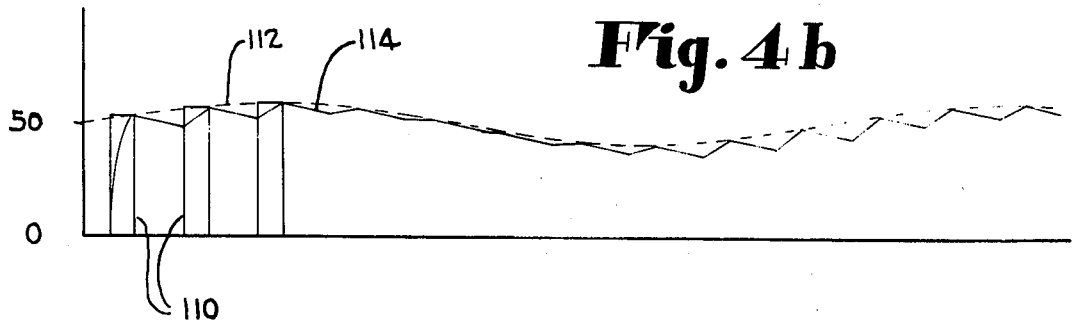

FIGS. 4*a* and 4*b* are graphs showing the voltage waveforms occurring at specified points in the circuit of FIG. 3.

Figure 1:
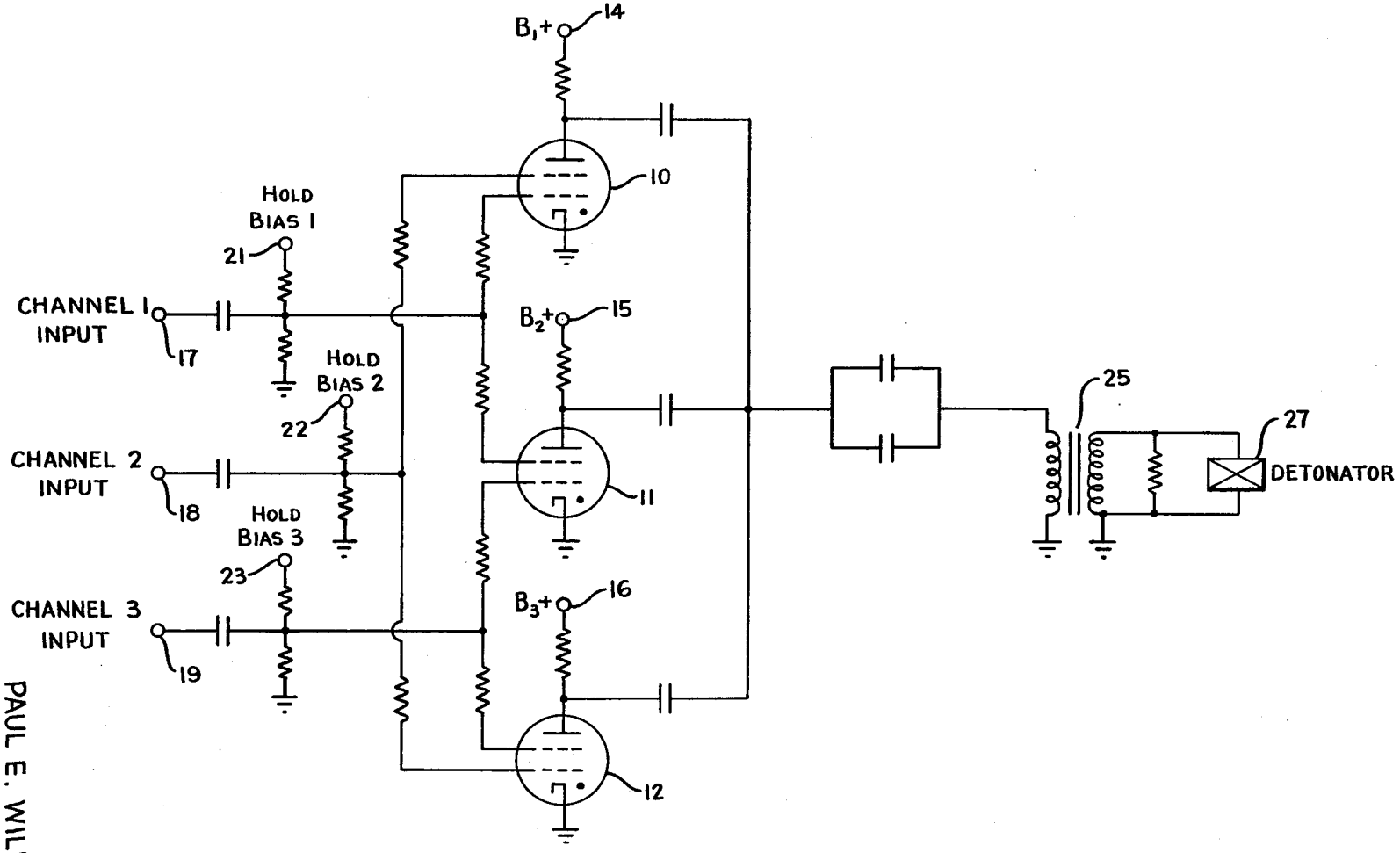
FIG. 1 is a circuit diagram of a firing circuit of a three channel fuze of the prior art.

In FIG. 1, the respective plate circuits of three dual-grid thyratrons 10, 11 and 12 are connected through plate resistors from the battery B sections 14, 15 and 16 of three separate fuze battery power supplies to circuit ground. The firing circuit input terminals 17, 18 and 19 receive, respectively, the target-indicating signals from three independent channels. Terminal 17 is connected through a coupling capacitor and isolating resistors to one of the control grids of both thyratrons 10 and 11. From terminal 18, channel two is similarly connected to the other grid of thyratron 10 and to one grid of thyratron 12. In the same manner, terminal 19 is connected to the remaining control grids of thyratron 11 and of thyratron 12. Negative grid bias is obtained from the C bias sections 21, 22 and 23 of the aforementioned fuze batteries. The holding bias from each battery is superimposed upon the input from one of the channels, maintaining the thyratrons cut-off in the absence of positive input voltages from the channels. It is apparent that thyratrons 10, 11 and 12 are cross-connected in their grid circuits in such a manner that an input signal from any two of the three fuze channels raises both control grids of at least one thyratron above the cut-off level.

The plate circuits of thyratrons 10, 11 and 12 are effectively in parallel. There are five separate energy storage capacitors connected as shown in FIG. 1 between the thyratron plates and a suitable transformer 25 in such a manner that a short circuited capacitor, an open capacitor, or both cannot disable the entire plate circuit. The B+ voltage of each power supply separately charges the storage capacitor of the associated channel. A detonator 27 connected across the secondary of transformer 25 serves as the output load of the firing circuit. When both grids of any of the thyratrons are simultaneously raised above cut-off, conduction occurs in its plate circuit and current is applied to detonator 27 to explode the projectile's warhead.

The mechanical layouts of the three channels are arranged so that, when subjected in the fuze to the same environment, they exhibit random failures. These random failures occur independently. The present state of the art permits design and fabrication of a single fuze channel with an early function probability of no more than 0.03 and a dud probability of no more than 0.02. That is, for a statistically large number of rounds, i.e., projectile flights, the fuze can be expected to energize the detonator at a distance greater than the specified maximum range on three percent of the flights. It will fail to detonate before impact on two percent of the flights. Since at least two channels must fail for a dud to occur and such failures are independent, the dud probability for the fuze system is $3\times(0.02)\times(0.02)$, or 0.0012. This calculation is based upon the fact that the probability of simultaneous failure of any two channels is the product of their individual failure probabilities, and there are three possibilities of co-channel failure, AB, AC and BC.

As was pointed out supra, the holding bias on two grids of the same thyratron in FIG. 1 must be overcome simultaneously to energize the detonator 27. If one channel generates a noise voltage of sufficient amplitude to hold those grids to which its output is connected above cut-off, then a random noise pulse from either of the other two channels could produce a firing pulse. In the most extreme instance, which due to the randomness of failures occurs infrequently, two channels might produce adequate continuous noise to give an early function. The probability of this happening is $3\times(0.03)\times(0.03)$, or 0.0027. However, the thyratron grids are coupled to the fuze channels by capacitor integrating circuits which have discharge times of about 100 milliseconds, as will appear subsequently. This means that any random noise signals, one in each channel, must occur within the same 100 millisecond time interval to give an early function. This requirement of simultaneity within a fixed time period, which is itself randomly distributed over the relatively long flight time of the missile, means that the above early function probability should be reduced by at least one order of magnitude. The early function probability is therefore taken to be 0.0003. The total probability of malfunction, the sum of the dud and early probabilities, is 0.0015. Accordingly, the calculated reliability, i.e., the probability of proper functions, for the fuze of FIG. 1 is 0.9985.

In Accordance with the present invention, a fuze with only two channels is able to maintain a reliability figure comparable to prior three channel systems, such as the one described above. In the various firing circuits of the prior art, a negative holding bias for the thyratron grids is taken directly from the fuze battery. In the present fuze, however, the holding bias is derived from the transmitter-receiver circuit rather than from a battery. A signal, normally present or purposely introduced in the transmitter-receiver, is fed as a monitoring signal through the associated channel. Any signal generated by the transmit-receive oscillator which is always present when it is operating properly, but which disappears if the oscillator fails, may serve as the monitoring signal. The signal used for monitoring is one which prior fuzes confine to the transmitter-receiver section; one having a frequency outside the pass band of conventional doppler-tuned amplifiers. This monitoring signal is, however, amplified by the channel amplifiers of the present fuze, provided they are functioning properly and then rectified to form thyratron holding biases. The monitoring signal therefore serves to detect any circuit or component failure, within the associated channel, of the type which would cause a dud. Such failures, which otherwise would cause duds, block the monitoring signal along with the target signal. This automatically removes the negative bias from the associated thyratron grids. As will appear subsequently, the automatic removal of holding bias from the grids connected to an inoperative channel allows the remaining channel to assume full control of the firing circuit, thereby preventing duds.

Figure 2:
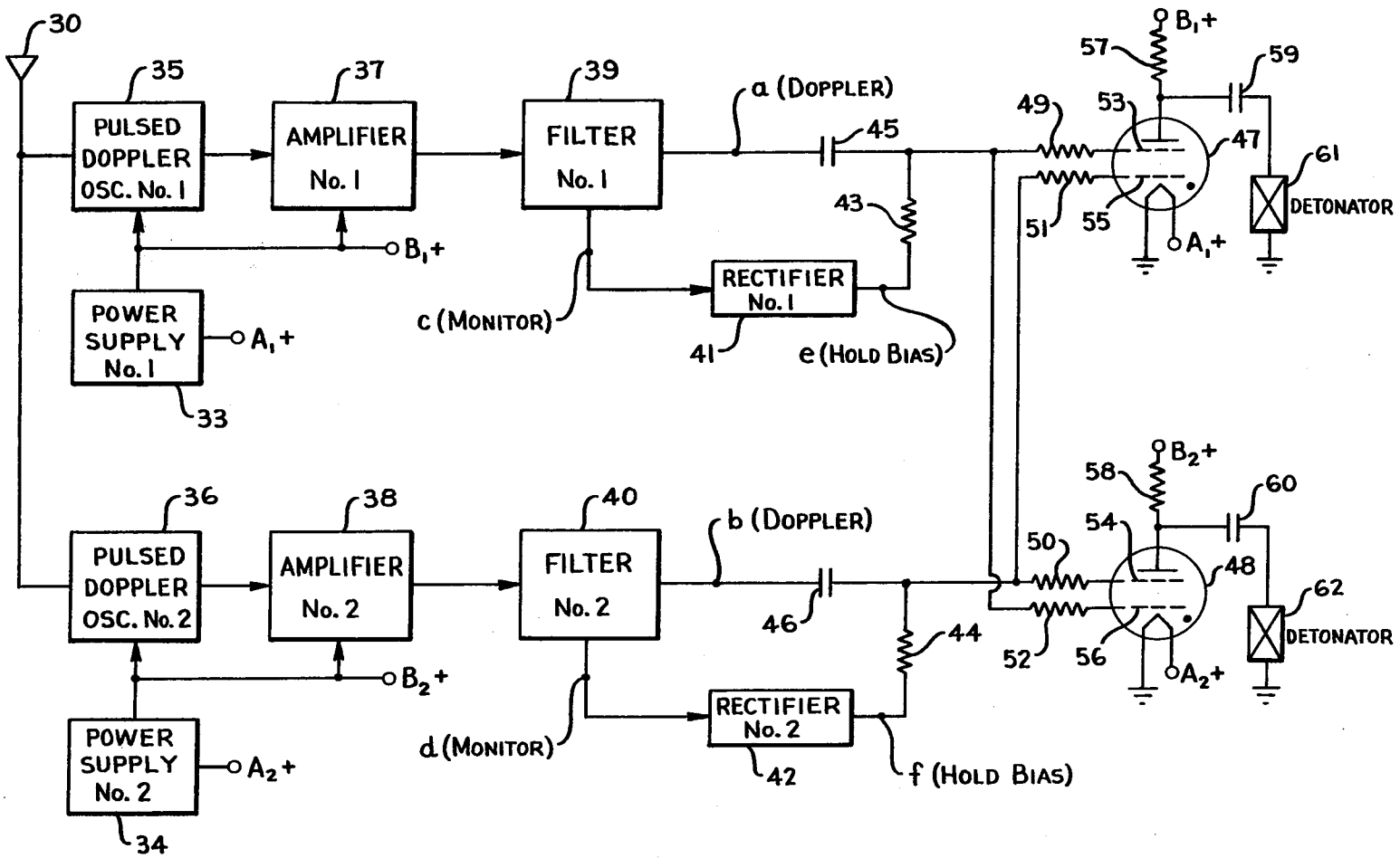
FIG. 2 is a block diagram of a novel multichannel fuze in accordance with the present invention. )×percent percent

FIG. 2 illustrates a typical embodiment of a two channel fuze in accordance with the present invention. Each channel is a self-pulsed circuit which incorporates the aforementioned monitoring principles. There, two self-pulsed oscillators 35 and 36 are connected to a common antenna 30. Each of the oscillators 35 and 36 employs a single triode tube, shown in FIG. 3, serving both as an oscillator and as a detector. Pulses of r-f energy are generated by oscillators 35 and 36 and radiated by antenna 30, while energy reflected by a target is returned to the antenna. The reflected signals received by antenna 30 are shifted in frequency from the transmitted signals due to the well known doppler effect. The difference in frequency between the transmitted and received signals is referred to as the doppler frequency. The diode action of the grid and cathode of each oscillator tube gives rise to a doppler frequency signal at the grid which is fed through amplifiers to the firing circuit. The amplifiers and firing circuit will energize the detonators when the aforesaid doppler signal falls within a predetermined frequency range and reaches a predetermined amplitude. The self-pulsed channels radiate short bursts of energy. If the reflected energy returns while an oscillator is on, the doppler frequency signal is formed as just described. However, if the energy returns from a target after an oscillator has cut itself off, there is no reaction at its grid and no doppler signal in the associated channel. For greater target distances the channel oscillators are off by the time a return signal is received, preventing detonation at distances greater than a desired range.

As is well known, any self-pulsing r-f oscillator effectively oscillates in at least two frequencies. The first is the fundamental radio frequency to be supplied by the oscillator. The second is its pulsing frequency, determined by the R-C time constant of the grid circuit. The rate at which pulses of r-f energy occur is termed the pulse-recurrence frequency, hereinafter referred to as the p.r.f., for convenience. It is this pulse-recurrence frequency which serves as the aforementioned monitoring signal, in the embodiment of FIG. 2. When the fuze is in proximity to a target, two separate signals are present at each oscillator grid and are applied to the balance of the system. These are the p.r.f. signal and the doppler frequency signal.

In FIG. 2, the grids of oscillators 35 and 36 are connected, respectively, to the inputs of channel amplifiers 37 and 38. Separate power supplies 33 and 34 provide plate circuit and filament power for the respective channels. Amplifiers 37 and 38, as will appear in detail subsequently, amplify both the p.r.f. monitoring signal and any doppler frequency signal due to a target. Amplifiers 37 and 38 are connected, respectively, to filter circuits 39 and 40 which serve to separate the doppler target signal from the monitoring signal. A doppler signal in the first channel appears at one output *a* of filter 39, while the associated monitoring signal passes to the second output *c* of filter 39. Filter 40 similarly has a first output *b* for doppler signals and a second output *d* where the second channel monitoring signal appears. A pair of rectifiers 41 and 42 are connected, respectively, to outputs *c* and *d* of filters 39 and 40, to rectify the p.r.f. signals. The resulting d-c voltages at points *e* and *f* in FIG. 2 act as holding biases for the firing circuit thyratrons.

The firing circuit of the present invention comprises a pair of dual-grid thyratrons 47 and 48. Thyratron 47 contains control grids 53 and 55 while thyratron 48 has similar grids 54 and 56. The plate of thyratron 47 is supplied with anode voltage by power supply 33 through resistor 57 and its cathode is grounded. Power supply 34 impresses anode voltage through resistor 58 upon the plate of thyratron 48, the cathode thereof being similarly grounded. The holding bias developed in the first channel by rectifier 41 is applied from point *e* through a resistor 43 and through series isolating resistor 49 to the first grid 53 of thyratron 47. Another grid isolating resistor 52 connects grid 56 of the other thyratron 48 to the junction of resistor 43 and 49, impressing the bias from point *e* upon grid 56. A d-c blocking capacitor 45 connects the first output *a* of filter 39 to the junction of resistors 43, 49 and 52, isolating the holding bias from point *a*. Further, any doppler frequency signals passed through filter 39 are superimposed upon the bias voltage from rectifier 41. Control grids 53 and 56 receive the resultant voltage. In an identical manner, resistors 44, 51 and 50 connect point *f* of the second channel to the remaining grids 55 and 54, respectively. Capacitor 46 connects output *b* of filter 40 to resistors 51 and 50. The holding bias from rectifier 42 and any doppler signal from the second channel are thereby applied to grids 55 and 54. Thyratrons 47 and 48 act as electronic switches to couple, respectively, the energy storage capacitors 59 and 60 to the fuze detonators 61 and 62.

Summarizing the operation of the system of FIG. 2, oscillators 35 and 36 effectively generate the two types of signals mentioned above in describing self-pulsed doppler oscillators. Short pulses of r-f energy are radiated by antenna 30. The oscillators operate at different radio frequencies, separated in frequency by an amount depending on their plate circuit selectivities. The r-f signals transmitted, respectively, by oscillators 35 and 36 are referred to hereinafter as $T_1$ and $T_2$, the corresponding reflected signals being $R_1$ and $R_2$. Since $T_1$ and $T_2$ are much higher in frequency than the respective pass bands of amplifiers 37 and 38, they do not appear in the balance of the fuze system. The p.r.f. signals, originating from the blocking action in the oscillator grid circuits, are present continuously, as long as the oscillators operate normally. Amplifiers 37 and 38 pass the respective p.r.f. signals from the oscillator grids to filters 39 and 40, provided the amplifiers are working properly. Filters 39 and 40 serve to impress only the p.r.f. monitoring signals upon rectifiers 41 and 42. The rectifiers convert the a-c monitoring signals to d-c holding biases for the fuze firing circuit.

At the same time, antenna 30 senses any signals $R_1$ and $R_2$ reflected by a target in proximity to the fuze. In accordance with conventional oscillating-detector operation, signals $R_1$ and $R_2$ are both mixed with $T_1$ by the grid-cathode diode of oscillator 35. In the second channel, $R_1$ and $R_2$ are similarly mixed with $T_2$ by oscillator 36. Amplifier 37 responds to the doppler frequency of the first channel; that is, to a frequency equal to $T_1 + R_1$. Amplifier 38 responds to the second channel doppler signal, which has a frequency of $T_2 + R_2$. Each amplifier suppresses the various other frequencies produced by the mixing operation. Filters 39 and 40 separate the doppler signals from the p.r.f. signals, directing the former to respective outputs *a* and *b*.

As long as all of the circuits of the first channel perform properly, the bias voltage developed by rectifier 41, in the absence of any doppler target signals, holds grids 53 and 56 below the firing potential of thyratrons 47 and 48. The second channel bias from point *f* similarly maintains grids 55 and 54 well below firing potential while the second channel is operative. Thyratrons 47 and 48 are of a type which does not conduct until both grids simultaneously exceed a predetermined firing potential. Now if a target is sensed, the first channel doppler signal appearing at point *a* is impressed through condenser 45 upon grids 53 and 56. It overcomes the holding bias from point *e* and raises grids 53 and 56 above the firing potential of thyratrons 47 and 48. At the same time, the second channel doppler signal from point *b*, when superimposed on the bias from rectifier 42, raises the voltage at grids 55 and 54 above cut-off. This coincident voltage rise at both grids of at least one thyratron serves to energize the fuze detonators. Thyratrons 47 and 48 begin conducting and current is applied from condensers 59 and 60 to detonators 61 and 62, exploding the warhead.

If a circuit failure should occur in either one of the channels, the associated doppler signal will not reach point *a* or point *b*, as the case may be. Such a failure might appear in the oscillator, power supply, or amplifier of a given channel. If the holding biases were obtained from separate batteries, as in the prior art, a dud would result, for at least one grid of each thyratron would remain below cut-off. In the present system, however, the same failure that prevents a doppler target signal from appearing also removes the bias from the grids to which that target signal would otherwise be applied. A channel failure blocks the development of bias in that channel and effectively raises the potential of one grid of each thyratron above cut-off. Therefore, the remaining operative channel can by itself, in its normal response, energize the fuze detonators 61 and 62. It is emphasized that single-channel operation is present only if the other channel has failed. When both channels are working, simultaneous sensing of a target is required. This system guards against internal noise and false target signals equally as well as prior art fuzes, such as the three channel system of FIG. 1. The monitoring signal detects any channel failure and, by the removal of grid bias, automatically switches the system over to the remaining good channel. This result is achieved by obtaining biases for respective grids from the channel which provides those same grids with a target signal.

For example, consider the operation if amplifier 37 should become inoperative for one reason or another. Then the first doppler signal from oscillator 35 is blocked by amplifier 37. But by the same token the p.r.f. monitoring signal is also blocked in amplifier 37. The holding bias disappears at point *e* and the potential of grids 53 and 56 is no longer below cut-off. The second channel alone can function the warhead by overcoming the bias from point *f* with the second doppler target signal applied to grids 55 and 54. The absence of the a.c. monitoring signal at the input to rectifier 41 indicates an inoperative channel and serves to switch the system over to the second channel alone. The first channel target signal is no longer required at the firing circuit input under these conditions.

FIG. 3 shows in wiring diagram form a typical embodiment of one of the channels of FIG. 2, with the same firing circuit. Therein, triode 70 is connected in a standard Hartley oscillator circuit to serve as the self-pulsed oscillating detector 35. Capacitor 71 together with grid-leak resistor 73 controls the oscillator's bias, producing the self-pulsed operation described supra. The waveform present at point 72 while a target is being sensed is as shown in FIG. 4*a*. It consists of pulses 110 having a nominal amplitude of −50 volts and occurring at the pulse repetition frequency. Further, the height of pulses 110 slowly varies as indicated by dotted curve 112 in FIG. 4*a*. Curve 112 represents the doppler signal produced by mixing $T_1$ and $R_1$ at the triode 70 grid. The doppler frequency signal, which typically has a peak-to-peak voltage of only 20 to 30 millivolts at a frequency of 50 to 250 c.p.s., is exaggerated in FIGS. 4*a* and 4*b* for clarity. Diode 74, capacitor 75 and resistor 77 comprise a peak detecting network. This network produces the sawtooth waveform 114 of FIG. 4*b* at point 76. During the first negative pulse 110, capacitor 75 quickly charges to the peak voltage, but then discharges slowly between pulses 110 due to the high resistance of resistor 77. Resistor 77 may be adjusted to give an optimum discharge time constant. Series capacitor 79 blocks the d-c component of the composite signal, so that waveform 114 is centered about zero volts at point 80 in FIG. 3. At point 80 the signal may typically comprise an 0.3 volt sawtooth at the pulse repetition frequency together with a long term variation which is the doppler target signal.

Pentodes 82 and 84 and the related circuits comprise the amplifier 37 of FIG. 2. Circuits 81, 83 and 85 are tuned resonant sections sensitive to the p.r.f. monitor component of waveform 114. Therefore, amplifier 37 is tuned to respond to the monitor signal and amplifies it to 8 to 15 volts at the output 88. The very low frequency doppler component of waveform 114 is also amplified to approximately 6 volts or more, the shunt capacitors in sections 81, 83 and 85 preventing the doppler signal from being shorted to ground. Feedback loops 86 and 87 determine the gain-frequency response characteristic in the doppler frequency range, controlling the burst height of the channel.

Referring to FIG. 3*b*, capacitors 91 and 95 with diodes 92 and 93 form a conventional voltage rectifying and doubling circuit to produce the holding bias at point 94. This circuit performs the function of rectifier 41 of FIG. 2. The p.r.f. monitor signal appearing across tuned output section 85 is applied to this voltage doubler, while the doppler target signal is blocked from the voltage doubler-rectifier input by capacitor 89. The hold bias is formed only from the monitor signal, the doppler frequency being separated from the monitor signal by capacitor 89. The voltage doubling action tends to establish −12 to −14 volts across capacitor 95; but this is clamped to −7.5 volts by a diode 96 with a −7.5 volt source connected to its anode. Thus, a −7.5 volt hold bias is applied to grids 53 and 56 as explained above regarding FIG. 2.

Both the doppler frequency signal and the p.r.f. signal which appear at point 88 are passed by series capacitor 45. Capacitors 101 and 104 primarily serve to store the doppler target voltage from point 88 for proper operation of the thyratron switches 47 and 48. These capacitors have a discharge time constant of about 100 milliseconds. This feature is necessary because the relative phase of the doppler signals of the two channels will vary as the target is approached. By storing the doppler signals in capacitors 101, 102, 103 and 104, simultaneous pulsing of all thyratron grids is assured, despite possible opposite phases of the doppler signals. Further, capacitors 101 and 104 short to ground any remaining portion of the p.r.f. signal, which is unwanted at the thyratron grids. This completes the separation of the doppler target signal from its associated p.r.f. signal. Capacitors 101 and 104 together with resistors 49 and 50 also integrate any high amplitude, low power noise spikes which might otherwise be able to cause false detonations.

Thyratrons 47 and 48 conduct whenever either has both grids raised above approximately −2.2 volts, with plate voltages of about 170 volts. The doppler signal of 6 volts or more through capacitor 45 overcomes the −7.5 volt bias sufficiently to raise grids 53 and 56 above the −2.2 volt cut-off level. When the second channel raises grids 55 and 54 in a similar manner, the detonators are energized.

The fuze is arranged to be fail-early. Assuming that mechanical parts and the batteries do not malfunction, if circuit failures occur in both channels at once, all grids will be made positive and the fuze will function. This might take place before the missile passes the maximum range position; i.e., an early function would result. Conventional safety and arming devices may be incorporated to prevent premature detonation at or just after launching. With this system, duds are positively prevented for any combination of responses by the two channels.

If desired, this system may be made fail-safe. To convert the system to fail-safe operation, batteries may be used to impress −2.5 volts at point 94. Point 94 is again clamped to −7.5 volts. Then, if doppler target signals and monitor signals are blocked in both channels, the batteries alone maintain all grids below the −2.2 volt firing level, assuring that no early functions can occur.

Normally, if the oscillators 35 and 36 should deteriorate in operation but not fail completely, i.e., if they operate at reduced sensitivity, their developed grid bias is also lower than normal. Then the p.r.f. monitoring signal will be reduced in magnitude. Thus the reduced sensitivity and weaker doppler target signal will tend to be automatically compensated for by the reduced p.r.f. amplitude and the resulting lower bias applied to the thyratron grids.

Reliability for the system just described compares favorably with prior art systems. Using the same reliability figures for each channel as that for the previous analysis of the fuze of FIG. 1, with the switching over to one channel alone if the other channel fails, the probability that both channels will fail is $(0.02) \times (0.02)$ or 0.0004. As to early functions with both channels working, the probability of both channels producing an early function is $(0.03) \times (0.03)$ or 0.0009. But since these must be simultaneous for the system to produce an early function, the overall early probability may, as before, be reduced by a factor of 10, to approximately 0.0001. A single channel alone will be relied upon 4 per cent of the time, each channel alone having a dud probability of 0.02. The probability of having an early function by this single channel is 0.03. At worst, neglecting the deduction of this 4 per cent of the cases from the total, the early functions of the fuze in single channel operation after the automatic switching mentioned above, will be $(0.04) \times (0.03)$ or 0.0012. Therefore, the probability of early functions is $[0.0001 + 0.0012]$, or 0.0013.

The total probability of malfunction, both duds and earlies, for the instant fuze system, is the sum, $0.0004 + 0.0013 = 0.0017$. Thus the calculated probability of proper functions is 0.9983, which compares very favorably with the 0.9985 reliability figure for the three channel fuze of FIG. 1.

The present invention is described with respect to self-pulsed doppler channels where the monitor is the p.r.f. signal. The invention is not limited to this embodiment, but may be advantageously employed with other types of channels. For example, in CW frequency modulation systems, the normally unused AM component generated in modulating the transmitter oscillator, a magnetron or klystron, may serve as the monitoring signal for each channel. Or in a simple low burst height CW fuze, each channel may contain a reflex grid detector oscillator connected directly to the firing circuit. A fraction of the oscillator grid bias is used as the monitoring hold bias. In any fuze which employs modulation of the transmitter, the modulation signal itself is a possible source of the monitoring signal.

It will be apparent that the embodiment shown is only exemplary and that various modifications can be made in construction and arrangement within the scope of the invention as defined in the appended claims.

We claim as our invention:

1. A fuze system comprising in combination: an antenna, a plurality of independent channels, a firing circuit, and detonator means; each of said channels comprising oscillating detector means for generating a transmitting signal and a monitoring signal, said detector means upon receipt of a target signal having an output containing a doppler frequency component, amplifying means connected to said oscillating detector means, means connected to said amplifying means for separating said monitoring signal from said doppler target signal, and rectifying means for forming a d-c holding bias from said monitoring signal; said firing circuit having first and second inputs; means for applying both the holding bias and the doppler target signal of one of said channels to said first firing circuit input, and means for applying both the holding bias and the doppler target signal of another one of said channels to said second firing circuit input said means responsive to said monitoring means enabling said fuze to operate by any remaining channels upon failure of one channel; said detonator means being connected to the output of said firing circuit.

2. A dual channel fuze comprising antenna means, a pair of independent electronic channels, a firing circuit, and a detonator; both of said channels containing an r-f signal source for generating a transmitting signal and also a monitoring signal, said signal source including detector means for mixing said transmitting signal with reflections from a target to produce a doppler target signal, an amplifier for amplifying both the doppler target signal and the monitoring signal, filter means connected to said amplifier for separating the doppler target signal from the monitoring signal, and rectifying means for converting only said monitoring signal to a negative bias voltage; said firing circuit comprising a pair of dual grid thyratrons and first and second input terminals, each terminal being connected to one grid of each thyratron; means for impressing both the bias voltage and the doppler target signal of one of said channels upon said first input terminal and means for impressing both the bias voltage and the doppler target signal of the other one of said channels upon said second input terminal said means responsive to said monitoring means enabling said fuze to operate by the remaining channel upon failure of one channel; and means connecting said detonator to the output of said firing circuit.

3. A two channel fuze having means for monitoring the operation of each channel, means responsive to said monitoring means for producing a negative bias voltage in each channel, a thyratron firing circuit having two separate input terminals, and means for applying each bias voltage to a different one of said input terminals, said means responsive to said monitoring means enabling said fuze to operate by the remaining channel upon failure of one channel.

4. In a proximity fuze having a pair of independent channels: an antenna, a pair of self-pulsed doppler oscillators connected to said antenna, a pair of peak voltage-detecting networks connected to the grids of said oscillators to develop an output waveform containing both a doppler frequency signal and a p.r.f. monitoring signal, a pair of amplifiers connected to the output of said peak voltage-detecting network, a pair of filter means for separating said doppler signals from said p.r.f. monitoring signals, a pair of rectifier networks one in each channel, means for applying only said p.r.f. monitoring signals to said rectifier networks to produce a negative holding bias as long as the corresponding channel operates properly, a thyratron firing circuit having a pair of dual grid thyratrons, a first input terminal connected to one grid of each thyratron, and a second input terminal connected to the remaining grid of each thyratron, means for applying both the doppler signal and the p.r.f. monitoring signal of a first one of said channels to said first firing circuit input terminal on each of said thyratrons, and means for applying the doppler signal and the p.r.f. monitoring signal from the second one of said channels to said second firing circuit input terminal on each of said thyratrons said means responsive to said monitoring means enabling said fuze to operate by the remaining channel upon failure of one channel.

* * * * *